US005317163A

United States Patent [19]

Obkircher

[11] Patent Number: 5,317,163

[45] Date of Patent: May 31, 1994

[54] FLYING DECOY

[75] Inventor: Bernt Obkircher, Horgenzell, Fed. Rep. of Germany

[73] Assignee: Dornier GmbH, Friedrichshafen, Fed. Rep. of Germany

[21] Appl. No.: 489,930

[22] Filed: Feb. 26, 1990

[51] Int. Cl.[5] ..... G01J 1/00; B64D 1/04; F41F 5/00; F42B 10/00

[52] U.S. Cl. ..... 250/495.1; 89/1.2; 102/334; 102/372; 102/502; 102/507

[58] Field of Search ..... 89/1.2; 342/5, 9, 11; 102/334, 502, 507, 372; 149/22, 108.2, 108.4; 244/3.1, 3.15; 250/495.1; 343/911 R

[56] References Cited

U.S. PATENT DOCUMENTS

| | | | |
|---|---|---|---|
| 1,803,537 | 5/1931 | Nissen | 102/372 X |
| 2,498,080 | 2/1950 | Jasse | 102/372 |
| 3,413,636 | 11/1968 | Migdal | 342/11 |
| 3,866,226 | 2/1975 | Benneche et al. | 342/9 |
| 3,946,555 | 3/1976 | Goede | 60/207 |
| 3,986,909 | 10/1976 | Macri | 149/22 X |
| 4,318,270 | 3/1982 | Orlick et al. | 149/22 X |
| 4,428,583 | 1/1984 | Feagle | 273/348.1 |

*Primary Examiner*—Stephen C. Buczinski
*Attorney, Agent, or Firm*—Connolly and Hutz

[57] ABSTRACT

A decoy for misdirecting heat-seeking and radar-echo-seeking missiles comprised of as main components a radar reflector and an engine and capable of simulating an aircraft in the infra-red wavelength of 1.5 to 2.5 mμ; 3-5 mμ; and 8-14 mμ and simultaneously in the radar band. The decoy is spectrally adapted in the infra-red range and is contoured to exhibit a large reflective surface with a doppler effect in the radar band. The parts are constructed so that the desired configuration and aerodynamic stability is achieved only when the decoy is prepared for operation. A plume covering an appropriately large area is produced and the content of the exhaust includes carbon dioxide and/or metallic powder to a high IR radiation of the plume.

3 Claims, 1 Drawing Sheet

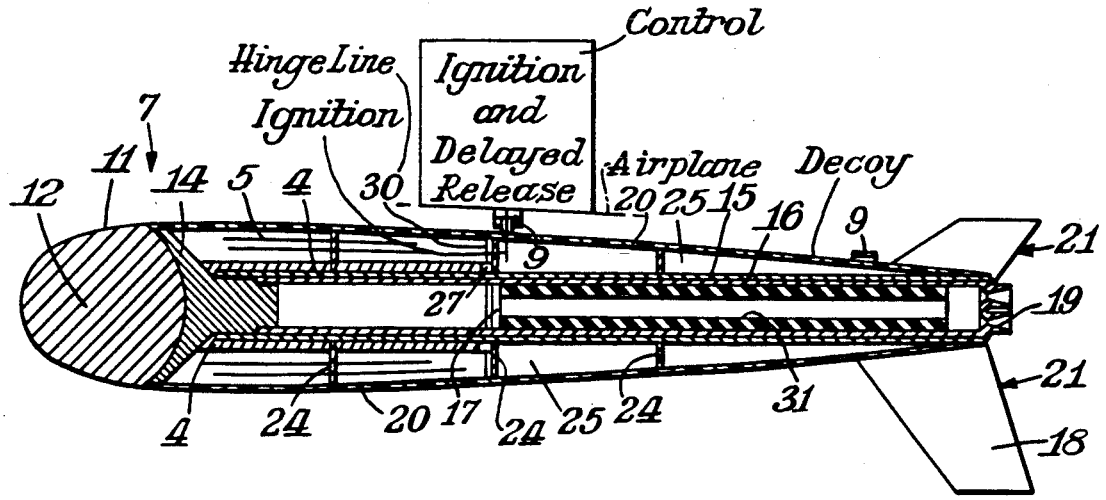
Control
Hinge Line
Ignition
Ignition and Delayed Release
Airplane
Decoy
7
11
12
14
5
4
30
20
25
15
16
9
21
19
27
31
17
24
18

FLYING DECOY

INTRODUCTION

The present invention relates to a flying decoy that decoys away from an aircraft, heat-seeking and radar-echo-seeking missiles.

BACKGROUND OF THE INVENTION

Decoys in the radar and infrared bands are used by aircraft to protect against approaching missiles. Devices are known, for instance, for aircraft to produce chaff and IR flares. This chaff is intended to act as decoy for radar and/or increase ground clutter at the same time. However, modern pulse-doppler radar can recognize such decoys, especially in the lookdown/shutdown mode. This is particularly true because simple decoys, in contrast to true targets, do not exhibit a corresponding doppler shift in the radar band. A second problem is caused by the fact that the flares—when they function as spot $MgF_2$ flares either exhibit an entirely inappropriate adaptation of the aircraft's IR radiation and, moreover, radiate excessively in the UV band, or—when they function as area flares on the basis of red phosphorus—they can not only be recognized as such because of the absence of independent motion, but because they do not emit their IR radiation until after they are beyond the sighting window of the IR searchhead which is locked onto the true target. In addition, flares will also be ineffective against imaging searchheads expected to be availabgle in the future because such decoys, in contrast to true targets, exhibit no contours or edges in the low-frequency range.

An aircraft able to recognize the illumination of a hostile fighter through its lookdown/shutdown aircraft radar, nevertheless cannot know whether the enemy is employing missiles with a passive IR searchhead and/or with a passive radar searchhead, which uses the target's reflection in the illumination radar as target information.

A flying decoy is disclosed in U.S. Pat. No. 3,866,226 as launched from an aircraft, and as having a streamlined body and a radar-reflection amplifying device as well as an engine. However that decoy has not proven to be successful against weapons with an IR searchhead or with a combined infrared and radar searchhead.

BRIEF SUMMARY OF THE INVENTION

The present invention is an improvement on the decoy of said U.S. Patent. The decoy of the present invention can simulate an aircraft with sufficient precision both in the applicable atmospheric IR windows (1, 5-2, 5 mu; 3-5 mu; 8-14 mu frequency) and simultaneously in the radar band. It is spectrally adapted in infrared, and there exhibits contours because of its shape and exhibits a large reflective surface with a doppler effect in the radar band. This will be more fully understood from the following description taken together with the drawings.

BRIEF DESCRIPTION OF THE DRAWING

The FIGURE shows a cross-section of a decoy according to this invention.

DETAILED DESCRIPTION

The decoy of the present invention can be constructed as a small, compact disposable missile which has two main components: a radar reflector and an engine.

The radar reflector consists, for instance, of an aerodynamically-shaped mantle that radar waves can penetrate and a device consisting of reflectors and/or lenses, which is optimized to produce within a volume that is as small as possible, a radar effective cross section (RCS) that is as large as possible. Thus, one can produce in the relevant frequency range maximum RCS values in excess of 10 $m^2$ with different lenses—such as, for instance, the Eaton-Lippmann lens—with a diameter of only a few centimeters and a length of a few decimeters. This device, or parts thereof, can also be designed to unfold, so that the desired RCS, together with aerodynamic stability, is only achieved after the decoy is prepared for firing.

The drawing figure is largely copied from U.S. Pat. No. 3,866,226 where it is fully described. That description also applies to the present figure. As in the noted patent the engine 16 is appropriately placed behind the reflector 12, contains a solid propellant charge 31, and provides the decoy with the speed necessary to produce the desired doppler shift in the radar band. According to the present invention various means can be used in the engine to produce appropriately large IR radiation and a plume covering an appropriately large area.

One technique is to select the propellant charge so that it has a content of carbon that increases the $CO_2$ content of the exhaust, or a content of boron or other metallic powder to achieve high IR radiation of the plume in the applicable IR windows. At least about 20% boron or carbon in the fuel is preferred. It is also desirable to install holes or slits 5 on the sides of the engine so that the gas of the burning propellant escapes laterally and thereby creates a very large plume considering the size of the engine and its jets. A separate supply of fuel 4 can be used for such lateral discharge.

In a design with slits or holes in the engine, these openings can be mechanically changed, in particular they can be mechanically opened. Thus, holes or slits can open by themselves during combustion because of increasing internal pressure (bursting of thin seals) or they can become exposed because of retreating solid fuel or they can be uncovered by a slidably mounted metal sheet that slides rearwardly in response to the thrust of the engine. The initial thrust of the decoy can be set at the start in such a way that the decoy initially has the same speed as the aircraft from which it is fired. This can be achieved, for instance, by automatically controlling (enlarging or decreasing) the jet of the decoy—before the decoy is released—in such a way that the initial thrust adjusts the speed of the decoy to that of the aircraft.

The decoy then flies as long as necessary close to (within the same range and bearing cell of a threatening searchhead) and parallel to the aircraft for about one second before moving away to the side and/or increasing altitude. This will divert the threatening missile or the threatening fire control radar from the real target and cause it to pursue the decoy since it will appear to be an attractive target both with regard to radar and IR. Since the decoy is designed as a missile, it even has contours in low-frequency infrared which could be important for imaging searchheads of the future during their final approach.

Folding of the decoy can be at hinge/line 20 which splits the decoy into front and back sections. A hinge connects the sections together so that they can be folded together for storage and unfolded in preparation for firing.

The masking of U.S. Pat. No. 3,866,226 is not essential. Without that masking, a decoy mounted in place is in position to be locked on by an enemy searchhead, even before firing.

Obviously many modifications and variations of the present invention are possible in the light of the above teachings. It is therefore to be understood that within the scope of the appended claims the invention may be practiced otherwise than as specifically described.

I claim:

1. In a flying decoy having a body equipped with a propulsion engine and having a magnified radar cross-section to decoy any missiles that seek radar echoes and/or heat, the improvement according to which the body is further equipped with means for combusting fuel not used for propulsion and lateral discharge openings for discharging the combustion products of the non-propulsion fuel to generate an exhaust plume larger or hotter or both larger and hotter than that of said propulsion engine.

2. The combination of claim 1 in which the propulsion fuel contains at least 20% powdered boron or carbon by weight.

3. The combination of claim 1 in which the lateral discharge openings are normally closed when the decoy is not under propulsion.

* * * * *